United States Patent [19]

Kashi

[11] Patent Number: 5,002,866

[45] Date of Patent: Mar. 26, 1991

[54] INTERNAL LATENT IMAGE TYPE SILVER HALIDE PHOTOGRAPHIC EMULSIONS

[75] Inventor: Yasuo Kashi, Kanagawa, Japan

[73] Assignee: Fuji Photo Film Co., Ltd., Kanagawa, Japan

[21] Appl. No.: 364,417

[22] Filed: Jun. 12, 1989

[30] Foreign Application Priority Data

Jun. 14, 1988 [JP] Japan ..... 63-146104

[51] Int. Cl.[5] ..... G03C 8/02

[52] U.S. Cl. ..... 430/567; 430/569; 430/599

[58] Field of Search ..... 430/567, 569, 599

[56] References Cited

U.S. PATENT DOCUMENTS 4,581,328 4/1986 Matsuyama ..... 430/567

4,863,845 9/1989 Murai et al. ..... 430/569

*Primary Examiner*—Paul R. Michl

*Assistant Examiner*—Janet C. Baxter

*Attorney, Agent, or Firm*—Sughrue, Mion, Zinn, Macpeak & Seas

[57] ABSTRACT

An internal latent image type silver halide photographic emulsion comprising internal latent image type silver halide photographic emulsions containing silver halide grains comprising an internal silver halide nucleus which has been doped with metal ions and/or chemically sensitized and an external silver halide shell which covers at least the light-sensitive sites on the internal nucleus, wherein during production of the silver halide grains the pAg at the end of the surface chemical sensitization stage, which is carried out in the presence of sulfur sensitizing agents, is at least 0.4 higher than the pAg at the beginning of the chemical sensitization stage.

8 Claims, No Drawings

INTERNAL LATENT IMAGE TYPE SILVER HALIDE PHOTOGRAPHIC EMULSIONS

FIELD OF THE INVENTION

This invention relates to internal latent image type silver halide photographic emulsions. More particularly, this invention relates to internal latent image type silver halide photographic emulsions which are used in direct positive photographic light-sensitive materials with outstanding age stability during the storage of the emulsion.

BACKGROUND OF THE INVENTION

As disclosed in the specifications of U.S. Pat. Nos. 3,317,322 and 3,761,276, it is known that reverse images are obtained by development in the presence of fogging agents or by uniform exposure during development of photographic light-sensitive materials containing internal latent image type silver halide grains, silver halide grains whose grain surfaces have been chemically sensitized, comprised of an internal silver halide nucleus (core) which is either doped with metal ions or chemically sensitized, or which has undergone both treatments, and an external silver halide shell covers at least the light-sensitive sites on the said internal nucleus (hereinafter referred to as core/shell grains).

However, the chemically sensitized nuclei produced by the chemical sensitization of the surfaces of such internal latent image type core/shell silver halide grains have poor age stability and have the disadvantage that the maximum density (Dmax) of the reverse image varies if after the internal latent image type core/shell silver halide grains having these chemically sensitized nuclei have been stored for a long time (for example, 10 days or more) at low temperatures (hereinafter referred to as cold-storage aging) said stored silver halide grains are introduced into direct positive photographic light-sensitive materials.

In order to obtain a sufficiently high Dmax in comparison to the minimum density (Dmin) of the reverse image, the chemical sensitization of the surfaces of internal latent image type core/shell silver halide grains is carried out using various methods. Also, it is known that the extent of chemical sensitization has an effect on negative image speed and on Dmin. Furthermore, the extent of surface chemical sensitization also has an effect on variations in Dmax and Dmin caused by cold-storage aging of the emulsions. It is thought that these variations caused by cold-storage aging are partially due to changes in the surface chemically sensitized nucleus during low temperature storage. Accordingly, in order to improve the cold-storage aging properties, it is useful to ensure that surface chemical sensitization is completed during that stage, and that changes in performance do not occur after that (namely, during emulsion storage, during the preparation of the coating solution or during the aging of the light-sensitive materials) due to changes in the sensitized nucleus or the effects of unreacted sensitizing agents remaining. By way of example, the method in which surface chemical sensitization is carried out in the presence of a polymer such as poly(N-vinylpyrrolidone) as disclosed in JP-B-60-55821 (the term "JP-B" as used herein means an "examined Japanese patent publication"), the method in which surface chemical sensitization is carried out after deactivating the additives used in the silver halide grain formation using deactivating agents as mentioned in JP-A-61-3137 (the term "JP-A" as used herein means an "unexamined published Japanese patent application"), and techniques such as changing the pAg of the surface chemical sensitization disclosed in Japanese Patent Application No. 63-40479 have been considered as methods of surface chemical sensitization which are in accordance with these requirements. However, none of these give fully satisfactory results.

SUMMARY OF THE INVENTION

Accordingly, an objective of this invention is to provide internal latent image type silver halide photographic emulsions with a high reversal image Dmax and little variation in the Dmax and Dmin upon cold-storage aging, and to provide a production method for such photographic emulsions.

The objective of this invention is achieved by an internal latent image type silver halide photographic emulsion wherein, in an internal latent image type silver halide photographic emulsion containing silver halide grains comprising an internal silver halide nucleus which has been doped with metal ions and/or chemically sensitized and an external silver halide shell which covers at least the light-sensitive sites on the internal nucleus (core), the pAg at the end of the surface chemical sensitization stage, which is carried out in the presence of sulfur sensitizing agents, is at least 0.4 higher than the pAg at the beginning of the chemical sensitization stage (The "pAg" as referred to herein indicates the value at 60° C. unless otherwise indicated).

DETAILED DESCRIPTION OF THE INVENTION

"Internal latent image type emulsion" as referred to in this invention denotes emulsions in which, when the silver halide emulsion is coated onto a transparent support, exposed for a fixed time of 0.01 to 1 second and developed for 3 minutes at 20° C. in Developing Solution A mentioned below (internal developing solution), the maximum density as measured by the usual photographic density measuring method is at least 5 times greater than the maximum density obtained when developing the silver halide emulsion which has been exposed in the same manner as above for 4 minutes at 20° C. in Developing Solution B mentioned below (surface developing solution).

| | |
|---|---|
| Developing Solution A: | |
| Hydroquinone | 15 g |
| Monomethyl-p-aminophenolsesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 l |
| Developing Solution B: | |
| p-Oxyphenylglycine | 10 g |
| Potassium Carbonate | 100 g |
| Water to make | 1 l |

Additionally, the objective of this invention is achieved by a silver halide photographic emulsion production method wherein, in the production method for the aforementioned internal latent image type silver halide photographic emulsions, surface chemical sensitization is carried out in the presence of sulfur sensitizing agents, and the production is effected by raising the pAg of the silver halide photographic emulsion by at least 0.4 by the end of the surface chemical sensitization stage.

In the production method for the emulsions of this invention, an internal silver halide nucleus which has been doped with metal ions or chemically sensitized, or which has undergone both treatments is first prepared. Then, the surface of this is covered with an external silver halide shell. It is sufficient for the shell to cover at least the light-sensitive sites on the internal part (the sites producing photodegraded silver upon exposure). However, it is preferable to cover the entire grain surface of the internal nucleus with the external shell in order to avoid increasing the Dmin as much as possible.

By way of example, cadmium salts, zinc salts, lead salts, thallium salts, iridium salts or complex salts thereof, iron salts or complex salts thereof and other such metal ions are normally used in the internal nucleus silver halide grain formation or physical ripening stage in amounts of $10^{-6}$ mol or more and $10^{-3}$ mol or less per mol of silver halide in the doping of the metal ions in the internal nucleus. In place of the above-described doping of metal ions, or in addition to this, the silver halide of the internal nucleus may be chemically sensitized using one or more types of noble metal sensitizing agents, sulfur sensitizing agents or reduction sensitizing agents. In particular, the speed increases if gold sensitization and sulfur sensitization are carried out. Methods for the treatment of the silver halide of the internal core and for covering the grain surface of the silver halide constituting the internal nucleus with a silver halide which becomes the external shell are well known; for example, the methods disclosed in U.S. Pat. Nos. 3,206,313, 3,317,323, 3,367,778 (but excluding the grain surface fogging process), and 3,761,276 and in Example 13 of Japanese Patent Application No. 61-299155 (corresponding to JP-A-63-151618) can be beneficially employed.

The ratio of the silver halide of the internal nucleus to the silver halide of the external shell is arbitrary, although, for every mole of the former, 2 to 10 moles of the latter are usually employed.

It is preferable that the silver halides of the internal nucleus and the external shell have the same composition, but they may also have different compositions. For the purposes of this invention, it is possible to use, for example, silver bromide, silver iodide, silver chloride, silver chlorobromide, silver bromoiodide, silver chlorobromoiodide and the like as the silver halide. Preferred silver halide emulsions are those with silver halides composed of at least 50 mol % of silver bromide and the most preferable emulsions are silver bromide emulsions or silver bromoiodide emulsions, particularly those containing silver bromide or about 10 mol % or less of silver iodide.

According to this invention, it is possible to produce core/shell silver halide grains with various grain sizes, although monodisperse core/shell silver halide grains with average grain diameters of about 0.2 to 4 microns, preferably about 0.25 to 3 microns and particularly preferably about 0.50 to 3 microns give good results.

The core/shell silver halide grains may have a cubic, octahedral or other such regular crystal form, they may have a spherical, tabular or other such irregular crystal form or they may have a complex form of these crystal forms, or again, they may be formed from mixtures of grains with various crystal forms. The use of tabular internal latent image core/shell silver halide grains also gives good results.

Details about the structure and production methods for tabular internal latent image core/shell silver halide grains are disclosed, for example, in JP-A-58-108528, Japanese Patent Application No. 61-299155 (corresponding to JP-A-63-151618) and Japanese Patent Application No. 62-208241.

With the internal latent image core/shell silver halide grains used in this invention, the addition agents may be deactivated by a deactivating agent ("Addition agents" as referred to herein are compounds which change the crystal form and the grain size of the silver halide or which have an effect on the photographic performance when forming silver halide grains, but which conversely have an adverse effect on the photographic performance if they remain after use). Furthermore, the relevant treatment may be carried out at any time from the end of grain formation until the end of the surface chemical sensitization. Specific examples of these treatments are disclosed in JP-A-61-3137.

The grain surfaces of the internal latent image core/shell silver halides which have undergone grain formation may be subjected to chemical sensitization in the presence of sulfur sensitizing agents, and active gelatin and compounds containing sulfur which are able to react with silver ions can be used as the sulfur sensitizing agents. It is possible to use thiosulfates, thioureas, thiazoles, rhodanines and other compounds such as compounds containing sulfur. Specific examples of these are disclosed in U.S. Pat. Nos. 1,574,944, 2,410,689, 2,278,947, 2,728,668 and 3,656,955. Furthermore, processes using active gelatin are disclosed in *The Theory of the Photoqraphic Process*, 4th edition, Macmillan, 1977, pp. 67–76 by T. H. James.

In addition to the sulfur sensitizing agents, gold and other such noble metal compounds can be used in the surface chemical sensitization of this invention. Complex salts of metals of Group VIII of the periodic table such as platinum, iridium and palladium can be used as the noble metal compounds in addition to gold complex salts, and specific examples of these are disclosed, for example, in U.S. Pat. Nos. 2,399,083, and 2,448,060 and in British Patent 618,061.

The method disclosed in Japanese Patent Application No. 63-40479 can be used advantageously in such surface chemical sensitization. This is to say, it is preferable to carry out the surface chemical sensitization at a pAg of 8.0 or below and, in order to obtain more marked effects, to maintain the pAg at 7.7 to 8.0.

It is preferable to carry out such surface chemical sensitization in the presence of a polymer such as poly(N-vinylpyrrolidone) or poly(N-vinyloxazolidone). Preferred substances for this type of polymer are disclosed in JP-B-60-55821.

With thus surface chemical sensitization, the most preferable results are provided by the use of sulfur sensitizing agents alone.

The conditions during the surface chemical sensitization process may be set arbitrarily, but it is generally preferable to use a pH of from 5 to 9 and a temperature of from 40° to 80° C. However, conditions outside this range may be employed depending on the circumstances.

At the end of the surface chemical sensitization, the emulsions are adjusted to the pAg of the conditions of this invention, that is to say the pAg is raised by 0.4 or more. "At the end of the surface chemical sensitization" as referred to here is the time at which it is desired to essentially end the sensitization and normally denotes the time at which the emulsion is rapidly cooled or immediately before this. The adjustment in pAg is normally effected by the addition of halides such as, potassium bromide, sodium bromide, potassium iodide and sodium chloride.

Furthermore, antifoggants and stabilizers may be added to the emulsion around the time of the adjustment.

The effects of this invention are evident when the pAg of the emulsion during storage is 0.4 to 4.0 higher than the pAg during the addition of the surface chemical sensitizing agents, but it is preferable that the pAg is 0.7 to 3.0 higher in order to obtain more marked effects.

Direct positive photographic light-sensitive materials using the internal latent image core/shell silver halide emulsions of this invention exhibit out-standing cold-storage aging properties and have little variation in the Dmax and Dmin even when the emulsions have been cold stored over a long period.

The reason for this is not entirely clear. While not desiring to be found, it is thought to be because the sensitized nucleus introduced by surface chemical sensitization is stabilized, or because the remaining chemical sensitizing agents are prevented from slowly reacting during cold storage, by the increase in the pAg by at least 0.4.

On the other hand, with silver halide grains of the so-called surface latent image type (negative type) in which only the surface has been chemically sensitized and which are not of the internal latent image type, the cold-storage aging property is not improved even when this invention is employed. It follows that the effects of this invention are first obtained by the use of internal latent image core/shell silver halide grains. Whereas the surface nucleus of internal latent image grains is acted upon by a fogging agent (nucleating agent) or an uniform exposure during the development which follows image exposure, the surface nucleus of surface latent image grains receives an action during image exposure. Why the surface chemically sensitized nucleus stabilization effect of this invention is marked in the former case and does not appear in the latter is not entirely clear at present, but, again not desiring to be found, it is presumed to rely on the aforementioned difference in structure.

The core/shell silver halide grains of this invention are dispersed in binders as is well known.

It is advantageous to use gelatin as the binder, but other hydrophilic colloids can also be used, if desired.

It is possible, for example, to use gelatin derivatives, graft polymers of gelatin and other high polymers, albumin, casein and other such proteins; hydroxyethylcellulose, carboxymethylcellulose, cellulose sulfate esters and other cellulose derivatives; and sodium alginate, starch derivatives and other sugar derivatives.

In addition to lime-processed gelatin, enzyme-processed gelatin as disclosed in the *Bull. Soc. Sci. Photo. Japan,* No. 16, p. 30, (1966) and acid-processed gelatin may be used as the gelatin, in addition to which it is possible to use the hydrolysis products and enzymolysis products of gelatin.

The internal latent image type silver halide photographic emulsions of this invention may be spectrally sensitized by, for example, methine dyes. Dyes which are used include, cyanine dyes, merocyanine dyes, complex cyanine dyes, complex merocyanine dyes, holopolar cyanine dyes, hemicyanine dyes, styryl dyes and hemioxonol dyes. Particularly useful dyes are those which are cyanine dyes, merocyanine dyes and complex merocyanine dyes. Any of the nuclei which are normally used in cyanine dyes as basic hetero rings can be employed in these dyes. That is to say, it is possible to use, the pyroline nucleus, the oxazoline nucleus, the thiazoline nucleus, the pyrrole nucleus, the oxazole nucleus, the thiazole nucleus, the selenazole nucleus, the imidazole nucleus, the tetrazole nucleus, the pyridine nucleus and the like. Nuclei in which alicyclic hydrocarbon rings are fused with these nuclei; and nuclei in which aromatic hydrocarbon rings are fused with these nuclei, which is to say, the indolenine nucleus, the benzindolenine nucleus, the indole nucleus, the benzoxazole nucleus, the naphthooxazole nucleus, the benzothiazole nucleus, the naphthothiazole nucleus, the benzoselenazole nucleus, the benzimidazole nucleus, the quinoline nucleus and the like can be used. The carbon atoms of these nuclei may be substituted, if desired.

As an example of nuclei having a ketomethylene structure in a merocyanine dye or a complex merocyanine dye, it is possible to use the pyrazolin-5-one nucleus, the thiohydantoin nucleus, the 2-thiooxazolidine-2,4-dione nucleus, the thiazolidine-2,4-dione nucleus, the rhodanine nucleus, the thiobarbituric acid nucleus and other 5 to 6-membered heterocyclic nuclei.

Useful sensitizing dyes are disclosed, for example, in West German Patent 929,080, U.S. Pat. Nos. 2,231,568, 2,493,748, 2,503,776, 2,519,001, 2,912,329, 3,655,394, 3,656,959, 3,672,897, 3,694,217, British Patent 1,242,588 and JP-B-44-14030.

These sensitizing dyes may be used alone or combinations thereof may be used, combinations of sensitizing dyes often being used for supersensitization in particular. Representative examples of these are disclosed, for example, in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609, 3,837,862, British Patent 1,344,281 and JP-B-43-4936.

When desired, the emulsions of this invention will be coated onto a support together with other photographic layers in order to produce light-sensitive materials using the internal latent image type silver halide photographic emulsions of this invention. The coated amount can vary, but desirable reversal images will normally be obtained when coating in an amount of about 40 mg to 800 mg of silver for each square foot of support is used.

The substances disclosed in *Research Disclosure* 176, 1978, Section 17643 XVII can be used as supports.

The internal latent image type silver halide photographic emulsions of this invention may contain, for example, polyalkylene oxides or the ether, ester, amine or other derivatives thereof, thioether compounds, thiomorpholines, quaternary ammonium salt compounds, urethane derivatives, urea derivatives, imidazole derivatives, 3-pyrazolidones and the like for the purposes of speed enhancement, contrast enhancement or development acceleration. For example, it is possible to use the substances disclosed in U.S. Pat. Nos. 2,400,532, 2,423,549, 2,716,062, 3,617,280, 3,772,021, 3,808,003 and the like.

The internal latent image type silver halide photographic emulsions of this invention can contain antifoggants and stabilizers. The compounds disclosed in *Research Disclosure,* Vol. 176, 1978, Section 17643 VI may be used as these compounds.

In particular, spectral sensitizing dyes, antifoggants and stabilizers can be used and included in any photographic emulsion production process and can be included at any stage up until just before coating after production. Examples of the former include the silver halide grain forming process, physical ripening process and chemical ripening process. In other words, apart from their principal function, the spectral sensitizing dyes, antifoggants and stabilizers are also used in order to prevent excessive halogen exchange and maintain a heterogenous halogen junction structure when obtaining junction structure grains of different halogen compositions or in order to limit the chemical sensitization nucleus-forming position, making use of their other properties such as strong absorbance on emulsions. For these, it is possible to refer to the disclosures in JP-A-55-26589, JP-A-58-111935, JP-A-58-28738, JP-A-62-7040, U.S. Pat. Nos. 3,628,960 and 4,225,666.

The internal latent image type silver halide photographic emulsions of this invention can contain developing agents. The substances disclosed in *Research Disclosure,* Vol. 176, 1978, Section 17643 XX can be used as the developing agents.

The internal latent image type silver halide photographic emulsions of this invention can be dispersed in a colloid capable of being hardened by various organic and inorganic film hardening agents. For example, it is possible to use the substances disclosed in *Research Disclosure,* Vol. 176, 1978, Section 17643 X as the film hardening agent.

The internal latent image type silver halide photographic emulsions of this invention can contain coating aids. The substances disclosed in *Research Disclosure,* Vol. 176, 1978, Section 17643 XI can be used as the coating aids.

The internal latent image type silver halide photographic emulsions of this invention can contain so-called color couplers. The substances disclosed in *Research Disclosure,* Vol. 176, 1978, Section 17643 VII can be used as the color couplers.

The internal latent image type silver halide photographic emulsions of this invention can also contain antistatic agents, plasticizers, matt agents, lubricants, ultraviolet absorbers, brightening agents, antiaerial foggants and the like.

The light-sensitive materials produced using the internal latent image type silver halide photographic emulsions of this invention may contain dyes for various objectives such as irradiation prevention or as filter dyes in the photographic emulsion layers or other hydrophilic colloid layers. The substances disclosed in *Research Disclosure,* Vol. 176, 1978, Section 17643 VIII can be used as such dyes.

The internal latent image type silver halide photographic emulsions of this invention produce reverse images by development in the presence of a fogging agent (nucleating agent) or by development under an uniform exposure. Representative examples of fogging agents which can be used here include the hydrazines disclosed in U.S. Pat. Nos. 2,588,982 and 2,563,785; the hydrazides and hydrazones disclosed in U.S. Pat. No. 3,227,552; the quaternary salts disclosed, for example, in British Patent 1,283,835, JP-B-49-38164 and U.S. Pat. Nos. 3,615,615, 3,719,494, 3,734,738, 4,094,683, and 4,115,122, the sensitizing dyes having a nucleating substituent group with a fogging action in the dye molecule disclosed in U.S. Pat. No. 3,718,470; and the acylhydrazinophenylthiourea-based compounds disclosed in U.S. Pat. Nos. 4,030,925 and 4,031,127. Apart from these, it is possible to mention the compounds disclosed in U.S. Pat. No. 4,139,387, JP-A-54-133126 and JP-A-54-74729.

It is desirable that the amount of fogging agents used here is an amount which gives an adequate maximum density when developing the internal latent image type silver halide emulsions of this invention with a surface developing solution. The fogging agents are preferably added to the photographic emulsion layers or the layers adjacent thereto.

The internal latent image type silver halide photographic emulsions of this invention can be used in various applications, but of these, they are advantageously used as the emulsions for direct positive photographic light-sensitive materials, emulsions for color reversal, emulsions for the color diffusion transfer process.

The photographic emulsions of this invention can also be used to obtain the desired transfer image in an image-receiving layer after a suitable development processing by combining them with a diffusion transfer color image providing substance of the type which releases diffusible dyes in response to the development of the silver halide. Many substances are known for these diffusion transfer color image providing substances. For example, it is possible to use the substances disclosed in U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, and 4,013,635, U.S. Published patent application Ser. No. B 351,673, British Patents 840,731, 904,364, and 1,038,331, West German Patent Application (OLS) Nos. 1,930,215, 2,214,381, 2,228,361, 2,317,134, and 2,402,900, French Patent 2,284,140, JP-A-51-113624 (corresponding to U.S. Pat. No. 4,055,428), JP-A-51-104343, and Japanese Patent Application Nos. 52-64533, and 52-58318 (corresponding to JP-A-53-149328 and JP-A-53-143323, respectively). Of these, the use of color image-providing substances of the type which are initially nondiffusible but which release diffusible dyes upon cleavage after a redox reaction with the oxidation products of the developing agents (hereinafter abbreviated to DRR compounds) is preferred.

Suitable DRR compounds can be represented by the general formula given below:

$$Y—D$$

where Y represents a redox center which has the function of releasing diffusible dyes as a result of development, and a ballast group is usually bonded to Y in order to render the compound immobile. Furthermore, D represents a dye (or a precursor thereof) moiety. This dye moiety may be bonded to the redox center by a linking group.

Specific examples of Y are disclosed, for example, in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,278,750, 4,135,929, 4,336,322, 4,371,604, and 4,139,389, JP-A-53-50736, JP-A-52-4819, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342, and JP-A-57-119345. Furthermore, as regards the dye moiety represented by D:

Examples of yellow dyes are the substances disclosed in: U.S. Pat. Nos. 3,579,200, 3,309,199, 4,013,633, 4,245,028, 4,156,609, 4,139,383, 4,195,992, 4,148,641, 4,148,643, and 4,336,322, JP-A-51-114930, JP-A-56-71072, *Research Disclosure* 17630 (1978), and ibid. 16475 (1977).

Examples of magenta dyes are the substances disclosed in: U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, JP-A-52-106727, JP-A-53-23628, JP-A-55-36804, JP-A-56-73057, JP-A-56-71060, and JP-A-55-134.

Examples of cyan dyes are the substances disclosed in: U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, JP-A-52-8827, JP-A-53-47823, JP-A-53-143323, JP-A-54-99431, JP-A-56-71061, European Patents 53,037, and 53,040, *Research Disclosure* 17630 (1978), and ibid. 16475 (1977).

Various known developing agents can be used in the development of the light-sensitive materials of this invention. It is therefore possible to use, either alone or in combination, polyhydroxybenzenes, (for example, hydroquinone, 2-chlorohydroquinone, 2-methylhydroquinone, catechol, pyrogallol); aminophenols (for example, p-aminophenol, N-methyl-p-aminophenol, 2,4-diaminophenol); 3-pyrazolidones (for example, 1-phenyl-3-pyrazolidones, 4,4-dimethyl-1-phenyl-3-pyrazolidone, 5,5-dimethyl-1-phenyl-3-pyrazolidone); ascorbic acids and the like. Furthermore, it is possible to use an aromatic primary amine developing agent, preferably a p-phenylenediamine-based developing agent, to obtain a color image in the presence of dye-forming couplers. Specific examples of these are 4-amino-3-methyl-N,N-diethylanilinehydrochloride, N,N-diethyl-p-phenylenediamine, 3-methyl-4-amino-N-ethyl-N-β-(methanesulfoamido)ethylaniline, 3-methyl-4-amino-N-ethyl-N-(β-sulfoethyl)aniline, 3-ethoxy-4-amino-N-ethyl-N-(β-sulfoethyl)aniline, 4-amino-N-ethyl-N (β-hydroxyethyl)aniline. Such developing agents may be included in alkaline processing compositions (processing elements) and they may also be included in appropriate layers of light-sensitive elements.

When DRR compounds are used in this invention, it is possible to use any silver halide developing agent which is capable of subjecting the DRR compounds to cross oxidation.

Sodium sulfite, potassium sulfite, ascorbic acid, redactones (for example, piperidinohexose redactone) and the like can be included in developing solutions as preservatives.

Direct positive images can be obtained with the light-sensitive materials of this invention by development with surface developing solutions. With the surface developing solutions, the developing process is essentially instigated by the latent image or the fogging nucleus on the surface of the silver halide grain. It is preferable not to include silver halide solvents in the developing solution, but a certain amount of silver halide solvent (for example, sulfite salts) may be present provided the internal latent image essentially plays no role until the end of development of development center on the silver halide grain surface.

The developing solution may contain, for example, sodium hydroxide, potassium hydroxide, sodium carbonate, potassium carbonate, trisodium phosphate, sodium metaborate and the like as alkalis and buffer agents. The content of these agents is selected for a pH of 10 to 13 and preferably for a pH of 11 to 12.5 in the developing solution.

The developing solution may contain benzyl alcohol and other color development accelerators. It is advantageous for the developing solution also to contain compounds which are normally used as antifoggants such as benzimidazoles (for example, 5-nitrobenzimidazole) and benzotriazoles (for example, benzotriazole, and 5-methylbenzotriazole) in order to reduce the minimum density of the direct positive image.

The light-sensitive materials of this invention can be processed with viscous developing solutions.

These viscous developing solutions are liquid compositions containing processing components which are needed for the development of the silver halide emulsion and for the formation of the diffusion transfer dye image. Their principal solvent is water but they can also contain hydrophilic solvents such as methanol and methyl Cellosolve. The processing compositions contain alkalis in sufficient amounts to maintain the required pH for initiating the development of the emulsion layers and to neutralize the acids which are produced during the various development and color image formation processes (for example, hydrobromic acid and other hydrohalide acids, acetic acid and other carboxylic acids). As the alkalis, lithium hydroxide, sodium hydroxide, potassium hydroxide, calcium hydroxide dispersions, tetramethyl ammonium hydroxide, sodium carbonate, trisodium phosphate, diethylamine and other alkali metal or alkaline earth metal salts or amines are used. It is desirable to include caustic alkalis at a concentration such that the pH is maintained at preferably about 12 or more, and in particular a pH of 14 or more, at room temperature. More preferably, the processing compositions contain high molecular weight polyvinyl alcohol, hydroxyethylcellulose, sodium carboxymethylcellulose and other hydrophilic polymers. These polymers may be used so as to achieve viscosities of 1 poise or more, and preferably a few hundred (500–600) to 1,000 poise, in the processing compositions at room temperature.

As regards the processing compositions, in order to prevent fogging of the silver halide emulsions with external light during processing or after processing, it is advantageous to include light-absorbing substances such as $TiO_2$, carbon black and pH indicating dyes and the desensitizing agents disclosed in U.S. Pat. No. 3,579,333, particularly with monosheet film units. Furthermore, it is possible to add development inhibitors such as benzotriazole to the processing solution compositions.

It is preferable that the abovementioned processing compositions are used in a vessel capable of being ruptured as disclosed, for example, in U.S. Pat. Nos. 2,543,181, 2,643,886, 2,653,732, 2,723,051, 3,056,491, 3,056,492, and 3,152,515.

When the light-sensitive materials of this invention are used in diffusion transfer photographic methods, it is preferable that these light-sensitive materials are in the form of film units. Photographic film units, which are to say film units arranged so that processing can be carried out by passing the film unit between a set of juxtaposed pressure members, basically comprise the following three elements:

(1) a light-sensitive element containing the fogging agent of this invention, (2) an image-receiving element, and (3) a processing element: for example, containing a silver halide developing agent and containing a means for releasing alkaline processing compositions such as a vessel which is capable of being ruptured within a film unit.

When the light-sensitive materials of this invention are used in the color diffusion transfer method, the photographic emulsions may be coated on the same support as that on which the image-receiving layer is coated and form a single body, or they may be coated onto different supports. Furthermore, the silver halide photographic emulsion layer (the light-sensitive element) and the image-receiving layer (the image-receiving element) may be provided in a combined form as a film unit, or they may be provided as individual and separate photographic materials. In this form, the film unit may pass through exposure, development and appreciation of the transfer image as a single body from start to finish, or it may be of the type which is peeled off after development.

The following examples are given to illustrate the present invention in greater detail but are not to be construed as limiting the present invention. Unless otherwise indicated, all parts, percents, ratios and the like are by weight.

EXAMPLE 1

Preparation of Emulsion A

An octahedral monodisperse emulsion with an average grain size of approximately 1 micron was obtained by using the double jet method by adding 360 cc of a 0.33 M/l silver nitrate solution and 360 cc of 0.35 M/l of a potassium bromide solution to 1 l of a 6 wt % gelatin solution containing 10 g of potassium bromide and 36 mg of 3,4-dimethyl-1,3-thiazoline-2-thione, over a period of about 40 minutes at 75° C. while stirring. Following this, chemical sensitization was carried out by adding 1.4 mg of sodium thiosulfate and 0.5 mg of potassium chloroaurate and heating at 75° C. for 80 minutes. Using the silver bromide grains obtained in this way as a core, 15 g of potassium bromide was added and then the double jet method was used to add 600 cc of a 1.39 M/l silver nitrate solution and 600 cc of a 1.00 M/l potassium bromide solution at 75° C. over a period of about 60 minutes. This emulsion was washed by the usual flocculation method, 30 g of dispersed gelatin were added and 1,200 g of an octahedral monodisperse core/shell emulsion with a final grain size of approximately 1.5 micron were obtained. The coefficient of variation of grain size was 10%. (There was a silver amount of 77 g and a gelatin amount of 60 g for every 1,200 g.)

Preparation of Samples A-1 to A-7

After adjusting Emulsion A to a pAg of 7.6 at 60° C., surface chemical sensitization was carried out for 60 minutes using 0.34 mg of sodium thiosulfate and 10 mg of poly(N-vinylpyrrolidone). As shown in Table 1, in each of the emulsions, the pAg was adjusted at the end of the surface chemical sensitization and they were immediately rapidly cooled.

The various samples were stored in cold storage at 4° C. for various lengths of time (3 days, 30 days, 60 days and 90 days), and after this evaluations were made using the methods shown below.

After adjusting the pAg of the various samples at 40° C. where required, they were coated onto cellulose acetate film supports in proportions of 400 mg/ft$^2$ of silver and 656 mg/ft$^2$ of gelatin. 6.8 mg of the fogging agent shown below were added for every mole of silver in the various emulsion samples. The various covered samples were exposed through an optical wedge for 1/10 second using a 400 lux tungsten light.

These various covered samples were processed in Developing Solution X shown below. The Dmax and the Dmin were measured for the coated samples.

The results obtained are shown in Table 1.

Fogging Agent

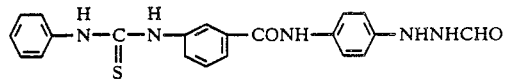

Developing Solution X

| | |
|---|---|
| Sodium Sulfate | 30 g |
| Hydroquinone | 10 g |
| 1-Phenyl-4-methyl-4-hydroxymethyl-3-pyrazolidinone | 0.75 g |
| Trisodium Phosphate | 40 g |
| Sodium Hydroxide | 10.7 g |
| 5-Methylbenzotriazole | 0.02 g |
| Water to make | 1 l |

TABLE 1

| Sample | Emulsion Used | pAg at the End of the Surface Chemical Sensitization | pAg Adjustment at Time of Coating | Emulsion Cold-Storage Aging Conditions (4° C.) 3 days | 30 days | 60 days | 90 days |
|---|---|---|---|---|---|---|---|
| A-1 (Comparative) | Emulsion A | 7.6 | None | Dmax = 1.20<br>Dmin = 0.21 | 1.05<br>0.26 | 0.82<br>0.33 | 0.54<br>0.38 |
| A-2 (Comparative) | Emulsion A | 7.9 | None | Dmax = 1.18<br>Dmin = 0.23 | 1.03<br>0.23 | 0.90<br>0.33 | 0.77<br>0.37 |
| A-3 (This Invention) | Emulsion A | 8.2 | None | Dmax = 1.12<br>Dmin = 0.22 | 1.00<br>0.22 | 0.92<br>0.23 | 0.88<br>0.22 |
| A-4 (Comparative) | Emulsion A | 7.6 | Adjusted to the same pAg as Sample A-5 | Dmax = 1.00<br>Dmin = 0.23 | 0.80<br>0.24 | 0.63<br>0.28 | 0.48<br>0.36 |
| A-5 (This Invention) | Emulsion A | 9.0 | None | Dmax = 1.00<br>Dmin = 0.24 | 1.00<br>0.24 | 0.95<br>0.23 | 0.92<br>0.24 |
| A-6 (Comparative) | Emulsion A | 7.6 | Adjusted same pAg as Sample A-7 | Dmax = 0.85<br>Dmin = 0.24 | 0.60<br>0.27 | 0.42<br>0.31 | 0.30<br>0.35 |
| A-7 | Emulsion | 10.8 | None | Dmax = 0.85 | 0.87 | 0.80 | 0.67 |

TABLE 1-continued

| Sample | Emulsion Used | pAg at the End of the Surface Chemical Sensitization | pAg Adjustment at Time of Coating | Emulsion Cold-Storage Aging Conditions (4° C.) 3 days | 30 days | 60 days | 90 days |
|---|---|---|---|---|---|---|---|
| (This Invention) | A | | | Dmin = 0.22 | 0.23 | 0.24 | 0.23 |

The following is evident from the results in Table 1. The Dmax is reduced and the Dmin is increased by cold storage of those samples in which the pAg was not increased by at least 0.4 at the end of the chemical sensitization (Samples A-1 and A-2). On the other hand, it can be seen that the samples in which the pAg is increased by at least 0.6 at the end of chemical sensitization exhibit stable Dmax and Dmin values even upon aging with cold storage (Samples A-3, A-5 and A-7). Furthermore, it can be seen that this result is not achieved even by adjusting to the same pAg as these samples during coating (Sample A-4 versus Sample A-5, Sample A-6 versus Sample A-7).

EXAMPLE 2

Preparation of Emulsion B

The double jet method was used to add 30 cc of a 0.7 M/l silver nitrate solution and 30 cc of a 0.7 M/l potassium bromide solution at 30° C. to 1 l of a 3.0 wt % gelatin solution containing 0.06 M of potassium bromide, over a period of 15 seconds with good stirring. Afterward, the temperature was raised to 75° C. and 400 cc of a 10 wt % gelatin solution were added.

After the end of the above first addition, 80 cc of a 0.6 M/l silver nitrate solution were added over a period of 30 minutes.

After this, the double 3et method was used to add 200 cc of a 1.47 M/l silver nitrate solution and 200 cc of a 1.47 M/l potassium bromide solution at an increasing flow rates (the flow at the end being 19 times that at the start). This time, the pBr was held at 2.8. This emulsion was washed using the usual flocculation method, dispersed gelatin was added and 400 g of a core emulsion were obtained. Ninety % of the tabular grains so obtained were hexagonal tabular grains which had a ratio of 2 or less by comparing the length of the edge with the largest length to the length of the edge with the smallest length. Their coefficient of variation was 15%. Furthermore, the average of diameters of circles having the same area as respective projected areas of these grains (hereinafter referred to as "the average corresponding circle diameter of these grains") was 0.4 micron and the average thickness was 0.08 micron.

800 cc of $H_2O$ and 30 g of gelatin were added to 200 g of the above core emulsion and, after dissolving, the temperature was raised to 75° C. Moreover, chemical sensitization was carried out by adding 30 mg of 3,4-dimethyl-1,3-thiazoline-2-thione, adding 3 mg of sodium thiosulfate and 1 mg of potassium chloroaurate and heating at 70° C. for 70 minutes. In the same way as in the core preparation, the double jet method was used to add 520 cc of a 1.47 M/l silver nitrate solution and 520 cc of a 1.47 M/l potassium bromide solution to the core emulsion chemically sensitized in this way while maintaining the pBr at 2.8 at 70° C. and at an increasing flow rate (the flow at the end being 5 times that at the start). This emulsion was washed using the usual flocculation method, 50 g of a dispersed gelatin were added and 1,500 g of a core/shell emulsion were obtained. The average corresponding circle diameter of the tabular grains so obtained was 0.8 micron and the average grain thickness was 0.13 micron. Furthermore, 85% of the tabular grains so obtained were hexagonal tabular grains with a ratio of 2 or less in a comparison between the length of the side with the longest length and the length of the side with the smallest length. Their coefficient of variation was 14%.

Preparation of Samples B-1 to B-4

Emulsion B was adjusted to a pAg of 8.0 at 60° C. and emulsions, which had undergone surface chemical sensitization for 40 minutes with 1.0 mg of sodium thiosulfate and 10 mg of poly(N-vinylpyrrolidone), were prepared. As shown in Table 2 below, the pAg of the various emulsions was adjusted at the end of the surface chemical sensitization and they were rapidly cooled.

The same coating procedure as that of Example 1 was carried out with each of the emulsion samples and the same tests of photographic properties were also carried out. The results obtained are shown in Table 2.

TABLE 2

| Sample | Emulsion Used | pAg at the End of the Surface Chemical Sensitization | pAg Adjustment at Time of Coating | Emulsion Cold-Storage Aging Conditions (4° C.) 3 days | 30 days | 60 days | 90 days |
|---|---|---|---|---|---|---|---|
| B-1 (Comparative) | Emulsion B | 8.0 | None | Dmax = 1.01<br>Dmin = 0.24 | 0.82<br>0.30 | 0.71<br>0.33 | 0.54<br>0.38 |
| B-2 (This Invention) | Emulsion B | 8.6 | None | Dmax = 0.92<br>Dmin = 0.24 | 0.88<br>0.25 | 0.83<br>0.25 | 0.84<br>0.25 |
| B-3 (Comparative) | Emulsion B | 8.0 | Adjusted to the same pAg as Sample B-4 | Dmax = 0.85<br>Dmin = 0.23 | 0.60<br>0.25 | 0.55<br>0.31 | 0.42<br>0.34 |
| B-4 (This Invention) | Emulsion B | 9.2 | None | Dmax = 0.84<br>Dmin = 0.25 | 0.81<br>0.24 | 0.82<br>0.23 | 0.80<br>0.24 |

It can be seen that the effects of this invention are achieved even when tabular internal latent image core/shell silver halide grains are used.

EXAMPLE 3

Light-sensitive Sheets Ia to Id and IIa to IId were prepared by coating the layers described below onto transparent polyethylene terephthalate supports in the order listed.

(1) Image-receiving layer containing 3.0 g/m$^2$ of copoly[styrene-N-vinylbenzyl-N,N,N-trihexylammonium chloride] and 4.0 g/m$^2$ of gelatin.

(2) White reflection layer containing 20 g/m$^2$ of titanium dioxide and 2.0 g/m$^2$ of gelatin.

(3) Opaque layer containing 2.7 g/m$^2$ of carbon black and 2.7 g/m$^2$ of gelatin.

(4) A layer containing 0.45 g/m$^2$ of a magenta DRR compound of the structure below, 0.10 g/m$^2$ of N,N-diethyllaurylamide, 0.0074 g/m$^2$ of 2,5-di-t-butylhydroquinone and 0.76 g/m$^2$ of gelatin.

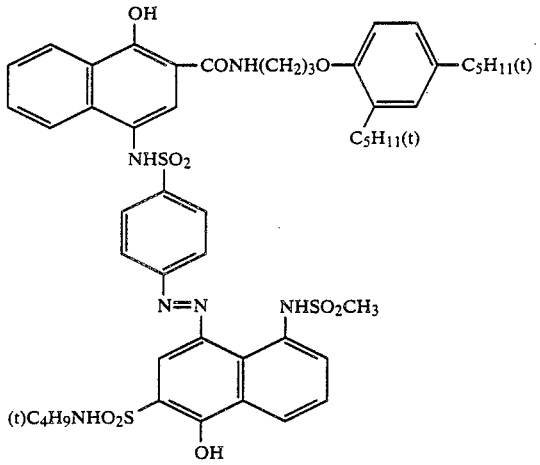

(5) A layer containing the emulsion shown in Table 3 below (1.4 g/m$^2$ as silver), a green-sensitive sensitizing dye, 0.05 mg/m$^2$ of the fogging agent described in Example 1 and 0.11 g/m$^2$ of 2-sulfo-5-n-pentadecylhydroquinone.sodium salt.

TABLE 3

| Light-sensitive Sheet No. | Emulsion Used | Period of Cold-Storage Aging |
|---|---|---|
| Ia | The emulsion used in Sample A-2 of the examples (comparative) | 3 days |
| Ib | The emulsion used in Sample A-2 of the examples (comparative) | 30 days |
| Ic | The emulsion used in Sample A-2 of the examples (comparative) | 60 days |
| Id | The emulsion used in Sample A-2 of the examples (comparative) | 90 days |
| IIa | The emulsion used in Sample A-3 of the examples (this invention) | 3 days |
| IIb | The emulsion used in Sample A-3 of the examples (this invention) | 30 days |
| IIc | The emulsion used in Sample A-3 of the examples (this invention) | 60 days |
| IId | The emulsion used in Sample A-3 of the examples (this invention) | 90 days |

(6) Layer containing 0.5 g/m$^2$ of gelatin.

Processing was carried out with a combination of light-sensitive sheets I and II shown above and the following elements.

| Processing Solution Composition | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium Sulfite (anhydrous) | 0.2 g |
| Carboxymethyl Cellulose.sodium salt | 58 g |
| Potassium Hydroxide (28% aqueous solution) | 200 cc |
| Benzyl Alcohol | 1.5 cc |
| Carbon Black | 150 g |
| Water | 685 cc |

The above processing solution was packed into a vessel capable of being ruptured under pressure.

Preparation of Cover Sheet

The cover sheet was prepared by coating the following layers (1) to (3) onto a transparent polyethylene terephthalate support in the order listed.

(1) A layer containing (11 g/m$^2$ of) an 80:20 (weight ratio) copolymer (molecular weight: 20,000–50,000) of acrylic acid and butyl acrylate and (0.22 g/m$^2$ of) 1,4-bis(2,3-epoxypropoxy)butane.

(2) A layer containing (4.3 g/m$^2$ of) acetyl cellulose (100 g of the acetyl cellulose produces 36.6 g of the acetyl group by its hydrolysis) and (0.23 g/m$^2$ of) a 60:40 (weight ratio) copolymer (molecular weight approximately 50,000) of styrene and maleic anhydride of which rings had been opened with methanol, and 0.65 mmol/m$^2$ of 5-(2-cyano-1-methylthio)-1-phenyltetrazole.

(3) A layer with a coated thickness of 2 microns in which a 49.7:42.3:3:5 (weight ratio) copolymer latex of styrene/n-butyl acrylate/acrylic acid/N-methylolacrylamide (molecular weight: 100,000) and a 93:4:3 (weight ratio) copolymer latex of methylmethacrylate/acrylic acid/N-methylolacrylamide (molecular weight: 100,000–150,000) were mixed in a solid fraction ratio of 6:4 of the former to the latter.

The above-described light-sensitive sheet and the above-described cover sheet were laid one on top of the other and exposure was made from the cover sheet side through an optical wedge with a density difference of 0.2 using a tungsten light at 2,854° K. (the maximum exposure was 10 C.M.C. on this occasion).

The processing solution was spread evenly between the light-sensitive sheet and the cover sheet by passing the various exposed photographic elements and the above processing solution through a set of juxtaposed pressure rollers at 25° C. The thickness of the spread processing solution was 85 microns.

The positive image densities 1 hour after spreading the processing solution were measured and the results obtained are shown in Table 4 below.

TABLE 4

| Light-sensitive Sheet No. | Dmax | Dmin | Remarks | |
|---|---|---|---|---|
| Ia | 2.22 | 0.34 | Emulsion cold storage 3 days aging | Comparative |
| Ib | 1.94 | 0.36 | Emulsion cold storage 30 days aging | |
| Ic | 1.82 | 0.39 | Emulsion cold storage 60 days aging | |
| Id | 1.63 | 0.41 | Emulsion cold storage 90 days aging | |
| IIa | 2.12 | 0.33 | Emulsion cold storage 3 days aging | This Invention |
| IIb | 2.08 | 0.33 | Emulsion cold storage 30 days aging | |
| IIc | 2.07 | 0.32 | Emulsion cold storage 60 days aging | |
| IId | 2.07 | 0.33 | Emulsion cold storage 90 days aging | |

It can be seen from the results in Table 4 that the emulsions according to this invention are stable with little performance change due to cold-storage aging.

EXAMPLE 4

Light-sensitive Sheets IIIa to IIIc and IVa to IVc were prepared by coating the following layers onto transparent polyethylene terephthalate film supports in the order listed.

(1) A mordant layer containing 3.0 g/m$^2$ of gelatin and 3.0 g/m$^2$ of the polymer latex mordant (molecular weight: 100,000–150,000) shown below.

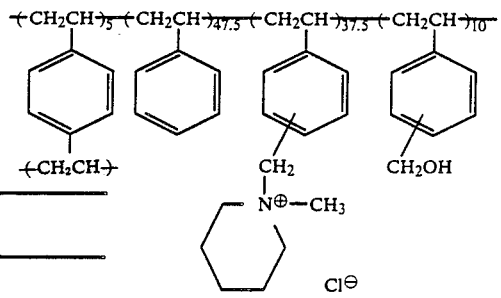

(2) A white reflection layer containing 18 g/m$^2$ of titanium dioxide and 2.0 g/m$^2$ of gelatin.

(3) A shielding layer containing 2.0 g/m$^2$ of carbon black and 1.0 g/m$^2$ of gelatin.

(4) A layer containing 0.44 g/m$^2$ of the cyan dye releasing redox compound shown below, 0.09 g/m$^2$ of tricyclohexylphosphate, 0.008 g/m$^2$ of 2,5-di-t-pentadecylhydroquinone and 0.8 g/m$^2$ of gelatin.

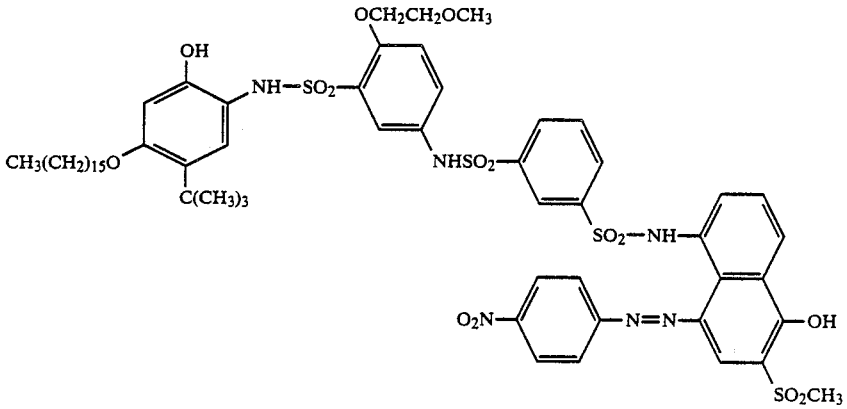

(5) A layer containing the emulsions shown in Table 5 below (1.03 g/m$^2$ as silver ), a red-sensitive sensitizing dye, 1.2 g/m$^2$ of gelatin, 0.04 mg/m$^2$ of the fogging agent described in Example 1 and 0.13 g/m$^2$ of 2-sulfo-5-n-pentadecylhydroquinone.-sodium salt.

TABLE 5

| Light-sensitive Sheet No. | Emulsion Used | Period of Cold-Storage Aging |
|---|---|---|
| IIIa | The emulsion used in Sample A-4 of the examples (comparative) | 3 days |
| IIIb | The emulsion used in Sample A-4 of the examples (comparative) | 60 days |
| IIIc | The emulsion used in Sample A-4 of the examples (comparative) | 90 days |
| IVa | The emulsion used in Sample A-5 of the examples | 3 days |
| IVb | The emulsion used in Sample A-5 of the examples | 60 days |
| IVc | The emulsion used in Sample A-5 of the examples | 90 days |

(6) A layer containing 0.43 g/m$^2$ of 2,5-di-t-pentadecylhydroquinone, 0.1 g/m$^2$ of tricyclohexylphosphate and 0.4 g/m$^2$ of gelatin.

(7) A layer containing (0.40 g/m$^2$ of) the magenta dye releasing redox compound of the structure shown below, (0.08 g/m$^2$ of) tricyclohexylphosphate and (0.9 g/m$^2$ of) gelatin.

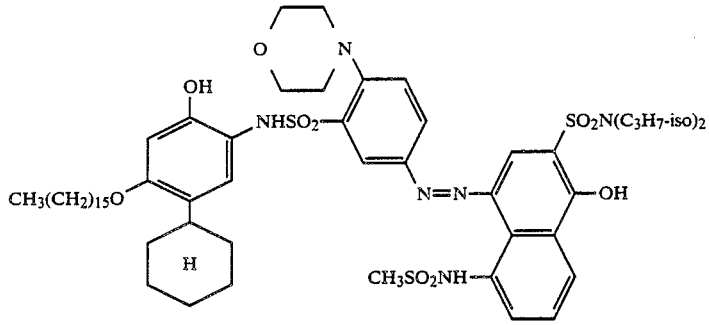

(8) A layer containing the same emulsion as that described for layer (5) (0.82 g/m$^2$ as silver), a green-sensitive sensitizing dye, 0.9 g/m$^2$ of gelatin, 0.03 mg/m$^2$ of the same fogging agent as that used in layer (5) and 0.08 g/m$^2$ of 2-sulfo-5-n-pentadecylhydroquinone.sodium salt.

(9) Layer identical to layer (6).

(10) A layer containing (0.53 g/m$^2$ of) the yellow dye releasing redox compound of the structure shown below, (0.13 g/m$^2$ of) tricyclohexylphosphate and (0.7 g/m$^2$ of) gelatin.

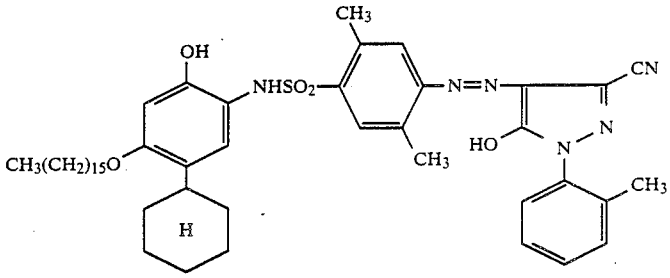

(11) A layer containing the same emulsion as that described for layer (5) (1.09 g/m$^2$ as silver), a blue-sensitive sensitizing dye, 1.1 g/m$^2$ of gelatin, 0.04 mg/m$^2$ of the same fogging agent as that described for layer (5) and 0.07 g/m$^2$ of 2-sulfo-5-n-pentadecylhydroquinone.sodium salt.

(12) A layer containing 1.0 g/m$^2$ of gelatin.

Processing was carried out combining the above-described light-sensitive sheet and the processing solution and cover sheet described in Example 3. The method of exposure, the method of spreading the processing solution and the method of measuring the density were as described in Example 3.

TABLE 6

| Light-sensitive Sheet No. | Dmax B | Dmax G | Dmax R | Remarks | |
|---|---|---|---|---|---|
| IIIa | 1.85 | 1.95 | 2.10 | Emulsion cold-storage 3 days aging | Comparative |
| IIIb | 1.73 | 1.80 | 1.75 | Emulsion cold-storage 60 days aging | Comparative |
| IIIc | 1.60 | 1.64 | 1.55 | Emulsion cold-storage 90 days aging | Comparative |
| IVa | 1.83 | 1.96 | 2.10 | Emulsion cold-storage 3 days | |

TABLE 6-continued

| Light-sensitive Sheet No. | Dmax B | Dmax G | Dmax R | Remarks | |
|---|---|---|---|---|---|
| | | | | aging | |
| IVb | 1.82 | 1.93 | 2.03 | Emulsion cold-storage 60 days aging | This Invention |
| IVc | 1.83 | 1.90 | 1.96 | Emulsion cold-storage 90 days aging | |

As shown by the results in Table 6, it can be seen that the emulsions according to the invention have good cold-storage aging properties.

The internal latent image type silver halide emulsions of this invention have the advantage that, by increasing the pAg at the end of a surface chemical sensitization process, which is carried out in the presence of sulfur sensitizing agents, to at least 0.4 higher than that at the beginning of the said process, it is possible to make the changes in the Dmax and the Dmin upon cold-storage aging extremely small and to obtain photographic properties (Dmax, Dmin) which are essentially the same as those when cold-storage aging has not occurred even when the above photographic emulsions have undergone cold-storage aging.

While the invention has been described in detail and with reference to specific embodiments thereof, it will be apparent to one skilled in the art that various changes and modifications can be made therein without departing from the spirit and scope thereof.

What is claimed is:

1. An internal latent image type silver halide photographic emulsion comprising internal latent image type silver halide photographic emulsions containing silver halide grains comprising an internal silver halide nucleus which has been doped with metal ions and/or chemically sensitized and an external silver halide shell which covers at least the light-sensitive sites on the internal nucleus, wherein during production of the silver halide grains the pAg at the end of the surface chemical sensitization stage, which is carried out in the presence of sulfur sensitizing agents, is at least 0.4 higher than the pAg at the beginning of the chemical sensitization stage, wherein the pAg is the value obtained at 60° C.

2. The internal latent image type silver halide photographic emulsion of claim 1, wherein the pAg is raised at the end of the chemical sensitization stage.

3. The internal latent image type silver halide photographic emulsion of claim 1, wherein the external silver halide shell covers the entire surface of the internal silver halide nucleus as a core.

4. The internal latent image type silver halide photographic emulsion of claim 1, wherein the internal silver halide nucleus is doped with at least one of a cadmium salt, a zinc salt, a lead salt, a thallium salt, an iridium salt or complex salt of iridium, or an iron salt or a complex salt of iron.

5. The internal latent image type silver halide photographic emulsion of claim 1, wherein the silver halide grains have average grain diameters of about 0.2 to about 4 microns.

6. The internal latent image type silver halide photographic emulsion of claim 1, wherein the pAg at the end of the surface chemical sensitization stage is 0.7 to 3.0 higher than the pAg at the beginning of the chemical sensitization stage.

7. The internal latent image type silver halide photographic emulsion of claim 1, wherein the internal silver halide grains are spectrally sensitized.

8. A diffusion transfer silver halide photographic element including at least one internal latent image type silver halide photographic emulsion of claim 1.

* * * * *